US010062995B2

(12) United States Patent
Doi

(10) Patent No.: US 10,062,995 B2
(45) Date of Patent: Aug. 28, 2018

(54) ELECTRICAL CONNECTOR

(71) Applicant: HIROSE ELECTRIC CO., LTD., Tokyo (JP)

(72) Inventor: Kentaro Doi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/364,400

(22) Filed: Nov. 30, 2016

(65) Prior Publication Data

US 2017/0170588 A1 Jun. 15, 2017

(30) Foreign Application Priority Data

Dec. 15, 2015 (JP) ..... 2015-244322

(51) Int. Cl.
*H01R 12/91* (2011.01)
*H01R 13/20* (2006.01)
(Continued)

(52) U.S. Cl.
CPC ..... *H01R 12/91* (2013.01); *H01R 12/7005* (2013.01); *H01R 13/502* (2013.01);
(Continued)

(58) Field of Classification Search
CPC .. H01R 12/716; H01R 12/91; H01R 13/6315; H01R 13/20; H01R 12/712
(Continued)

(56) References Cited

U.S. PATENT DOCUMENTS 5,201,663 A * 4/1993 Kikuchi ..... H01R 13/6315 439/248
6,155,858 A * 12/2000 Ozawa ..... H01R 13/6315 439/248

(Continued)

FOREIGN PATENT DOCUMENTS

| | | | |
|---|---|---|---|
| EP | 2846409 | A2 | 3/2015 |
| JP | 2014-099361 | A | 5/2014 |
| WO | 2004062041 | A1 | 7/2004 |

OTHER PUBLICATIONS

English Translation of WO 2004/062041.*

*Primary Examiner* — Michael A Lyons
*Assistant Examiner* — Matthew T Dzierzynski
(74) *Attorney, Agent, or Firm* — Kubotera & Associates, LLC

(57) ABSTRACT

An electrical connector includes a terminal having a connecting portion to be connected to an electrical circuit board and a contact portion to be contacted with a mating connector; and a housing for holding the terminal. The housing includes a fixed housing and a movable housing arranged to be movable relative to the fixed housing. The terminal includes a fixed side held portion held with the fixed housing, a movable side held portion held with the movable housing, and an elastic portion situated between the fixed side held portion and the movable side held portion. The housing includes an accommodating space for accommodating the elastic portion. The elastic portion includes a first wave shape portion having a first bent portion and a pair of first extending portions. The first extending portions are configured to extend away from each other with a distance in between decreasing toward the first bent portion.

5 Claims, 5 Drawing Sheets

(51) Int. Cl.

| | |
|---|---|
| ***H01R 12/70*** | (2011.01) |
| ***H01R 13/631*** | (2006.01) |
| ***H01R 13/502*** | (2006.01) |
| *H01R 12/71* | (2011.01) |

(52) U.S. Cl.
CPC ..... *H01R 13/6315* (2013.01); *H01R 12/707* (2013.01); *H01R 12/712* (2013.01)

(58) Field of Classification Search
USPC ..... 439/248, 81, 247, 74
See application file for complete search history.

(56) References Cited

U.S. PATENT DOCUMENTS

| | | | | |
|---|---|---|---|---|
| 7,125,260 | B2 * | 10/2006 | Orita | H01R 12/57 439/247 |
| 7,862,345 | B2 * | 1/2011 | Fukazawa | H01R 12/716 439/74 |
| 9,033,722 | B2 * | 5/2015 | Kobayashi | H01R 12/712 439/248 |
| 9,033,743 | B2 * | 5/2015 | Kobayashi | H01R 13/11 439/637 |
| 9,088,113 | B2 * | 7/2015 | Funayama | H01R 12/91 |
| 9,190,753 | B2 * | 11/2015 | Takaki | H01R 12/716 |
| 9,209,557 | B2 * | 12/2015 | Kobayashi | H01R 12/716 |
| 9,225,089 | B2 * | 12/2015 | Sato | H01R 4/028 |
| 9,270,045 | B2 * | 2/2016 | Kimura | H01R 13/41 |
| 9,281,594 | B2 * | 3/2016 | Funayama | H01R 12/91 |
| 2014/0134890 | A1 | 5/2014 | Kobayashi et al. | |
| 2015/0044914 | A1 | 2/2015 | Kimura | |
| 2017/0033480 | A1 * | 2/2017 | Sato | H01R 12/716 |

* cited by examiner

ELECTRICAL CONNECTOR

BACKGROUND OF THE INVENTION AND RELATED ART STATEMENT

The present invention relates to an electrical connector to be attached to an electrical circuit board for connecting a mating connecting member to the electrical circuit board in a direction perpendicular to a surface of the electrical circuit board.

Patent Reference has disclosed a conventional electrical connector for connecting an electrical circuit board. The conventional electrical connector includes a housing. The housing includes a fixed housing to be fixed to the electrical circuit board and a movable housing capable of moving relative to the fixed housing. The conventional electrical connector further includes a terminal disposed between the fixed housing and the movable housing.

Patent Reference: Japanese Patent Publication No. 2014-099361

In the conventional electrical connector disclosed in Patent Reference, the fixed housing to be fixed to the electrical circuit board is formed in a rectangular frame shape, so that a central portion at a center of the rectangular frame shape is opened and penetrates through a vertical direction of the fixed housing. The movable housing is accommodated in the central portion of the fixed housing such that a space is created between the fixed housing and the movable housing around a circumference of the movable housing. The movable housing includes a hollow portion that is opened upwardly, so that a mating connector as a mating connecting member is fitted in the hollow portion from above.

In the conventional electrical connector, the terminal includes an elastic piece portion on one end portion thereof. The elastic piece portion has a contact portion to be contacted with and connected to the mating connector, and is situated in the hollow portion of the movable housing. Further, the terminal includes a board connecting portion on the other end portion thereof. The board connecting portion protrudes outside the fixed housing.

In the conventional electrical connector, the elastic piece portion of the terminal disposed at the one end portion of the terminal extends to a bottom portion of the movable housing, and an arm portion is provided a lower end portion of the elastic piece portion. The arm portion extends outside the movable housing. A fixed piece portion is formed at a middle position of the arm portion, and the fixed piece portion is fitted in and fixed to a hole portion of the movable housing.

In the conventional electrical connector, the board connecting portion of the terminal disposed at the other end portion of the terminal is connected to the arm portion situated at a bottom portion of the fixed housing. A fixed piece portion is formed at a middle position of the arm portion, and the fixed piece portion is fitted in and fixed to a hole portion of the fixed housing.

In the conventional electrical connector, the terminal further includes a movable portion disposed between the arm portion on the movable housing side and the arm portion on the fixed housing side. The movable portion is formed of an open loop shape rising from a position of the bottom portion, so that the movable portion is capable of deforming. The movable portion includes a base portion connected to the arm portion on the movable housing side and the arm portion on the fixed housing side.

In the conventional electrical connector, the movable portion with the open loop shape is disposed such that the base portion thereof is situated close to that of the adjacent movable portion, so that the movable portion is capable of deforming to a large extent. Accordingly, the movable portion is formed in a substantially circular shape as a whole. Further, the movable portion is situated in the space between the fixed housing and the movable housing. When the movable portion is elastically deformed, the movable housing is capable of moving in any direction of an orthogonal coordinate axis in the space, thereby achieving a floating effect.

In general, the conventional electrical connector is required to have a small height size from the surface of the electrical circuit board. At the same time, the conventional electrical connector is preferably capable of floating in any direction.

In the conventional electrical connector disclosed in Patent Reference, the terminal has the movable portion having the substantially loop shape, so that the movable portion is capable of deforming to a large extent. When the conventional electrical connector is configured to increase a floating amount in the height direction thereof (the direction perpendicular to the plate surface of the electrical circuit board) or the width direction thereof (the direction in parallel to the plate surface of the electrical circuit board), it is necessary to increase the size of the movable portion in the height direction or the width direction. As a result, it is necessary to increase the size of the conventional electrical connector in the height direction or the width direction thereof.

In view of the above problems, an object of the present invention is to provide an electrical connecting member capable of solving the problems of the conventional electrical connector. According to the present invention, it is possible to secure the floating amount of the electrical connector in the height direction and the width direction of the electrical connector without increasing the size of the electrical connector in the height direction thereof.

Further objects and advantages of the present invention will be apparent from the following description of the present invention.

SUMMARY OF THE INVENTION

In order to solve the problems described above, according to a first aspect of the present invention, an electrical connector is provided for connecting an electrical circuit board to a mating connecting member. The electrical connector includes a terminal and a housing for holding the terminal. The terminal has a connecting portion to be connected to the electrical circuit board and a contact portion to be contacted with the mating connecting member. The housing includes a fixed housing to be attached to the electrical circuit board and a movable housing arranged to be movable relative to the fixed housing, so that the mating connecting member is fitted in the movable housing.

According to the first aspect of the present invention, the terminal includes a fixed side held portion held with the fixed housing, a movable side held portion held with the movable housing, and an elastic portion connecting between the fixed side held portion and the movable side held portion. The elastic portion is configured to be capable of elastically deforming. The housing includes an accommodating space situated between the fixed housing and the movable housing for accommodating the elastic portion. The elastic portion includes a plurality of wave shape portions formed in one continuous band shape portion. The wave shape portion has a plurality of bent portions repeatedly bending continuously in bend directions. Each of the wave shape portions situated adjacent to the fixed side held portion and the movable side held portion has an enlarging width portion, in which an opening width of a wave shape increases away from the bent portions.

According to the first aspect of the present invention, when the terminal receives an external force, the elastic portion of the terminal is elastically deformed. Accordingly, the movable housing is moved relative to the fixed housing by an elastic deformation amount of the elastic portion. As a result, it is possible to achieve floating of the electrical connector.

According to the first aspect of the present invention, the elastic portion includes the wave shape portions formed in one continuous band shape portion. The wave shape portion has the bent portions repeatedly bending continuously in bend directions. Accordingly, even when the elastic portion does not have a large size in the height direction thereof, it is possible to sufficiently secure the elastic deformation amount. As a result, it is possible to minimize a size of the connector in the height direction thereof.

According to the first aspect of the present invention, the wave shape portions situated adjacent to the fixed side held portion and the movable side held portion have the enlarging width portions. Accordingly, when the wave portions are elastically deformed in the width direction thereof, and the wave shape portions situated adjacent to the fixed side held portion and the movable side held portion approach closer to each other at base portions thereof, the wave shape portions do not contact with each other. Accordingly, it is possible to prevent the terminal from being damaged. Further, it is possible to secure a sufficient floating amount.

According to a second aspect of the present invention, an electrical connector is provided for connecting an electrical circuit board to a mating connecting member. The electrical connector includes a terminal and a housing for holding the terminal. The terminal has a connecting portion to be connected to the electrical circuit board and a contact portion to be contacted with the mating connecting member. The housing includes a fixed housing to be attached to the electrical circuit board and a movable housing arranged to be movable relative to the fixed housing, so that the mating connecting member is fitted in the movable housing.

According to the second aspect of the present invention, the terminal includes a fixed side held portion held with the fixed housing, a movable side held portion held with the movable housing, and an elastic portion connecting between the fixed side held portion and the movable side held portion. The elastic portion is configured to be capable of elastically deforming. The housing includes an accommodating space situated between the fixed housing and the movable housing for accommodating the elastic portion. The elastic portion includes a plurality of wave shape portions formed in one continuous band shape portion.

According to the second aspect of the present invention, the terminal further includes a fixed side transition portion extending from the elastic portion to the fixed side held portion and a movable side transition portion extending from the elastic portion to the movable side held portion. The fixed side transition portion and the movable side transition portion are situated outside a range of the wave shape portions in a height direction of the wave shape portions.

According to the second aspect of the present invention, similar to the first aspect, when the terminal receives an external force, the elastic portion of the terminal is elastically deformed. Accordingly, the movable housing is moved relative to the fixed housing by an elastic deformation amount of the elastic portion. As a result, it is possible to achieve floating of the electrical connector.

According to the second aspect of the present invention, similar to the first aspect, the elastic portion includes the wave shape portions formed in one continuous band shape portion. The wave shape portion has the bent portions repeatedly bending continuously in bend directions. Accordingly, even when the elastic portion does not have a large size in the height direction thereof, it is possible to sufficiently secure the elastic deformation amount.

According to the second aspect of the present invention, in addition to the first aspect, the fixed side transition portion and the movable side transition portion are situated outside the range of the wave shape portions in the height direction of the wave shape portions. Accordingly, it is possible to dispose the wave shape portions in a space opposite to the fixed side transition portion and the movable side transition portion in the height direction of the wave shape portions. As a result, it is possible to increase the height of the wave shape portions.

According to the second aspect of the present invention, the wave shape portions are not disposed between the fixed side transition portion and the movable side transition portion in a direction connecting between the fixed side transition portion and the movable side transition portion (the width direction of the wave shape portions). Accordingly, even when the wave portions are elastically deformed in the width direction thereof, the fixed side transition portion does not contact with the movable side transition portion.

According to the second aspect of the present invention, the wave shape portions are formed in the shape repeatedly bent in the vertical direction. Further, when one of the wave shape portions situated at the middle is situated at a position slightly higher than that of the bottom portion, it is possible to dispose the fixed side transition portion closer to the movable side transition portion. Accordingly, it is possible to minimize the side of the electrical connector in the connector width direction.

According to a third aspect of the present invention, each of the wave shape portions of the terminal may be formed to have an extending portion between the bent portions situated adjacent to each other. Accordingly, the elastic portion is capable of deforming with the bent portion as a pivot, so that the elastic portion is capable of elastically deforming as a whole. Further, when a length of the extending portion is increased, it is possible to increase the elastic deformation amount of the elastic portion.

According to a fourth aspect of the present invention, each of the wave shape portions of the terminal may be formed to have the bent portion formed in a band shape bent within a plate surface thereof. Further, the terminal may be formed to have the extending portion having a width smaller than that of the bent portion. Accordingly, when the elastic portion is elastically deformed with the bent portion as the pivot, the extending portion tends not to contact with the adjacent extending portion.

According to the present invention, it should be noted that the mating connecting member may include an electrical connector or an electrical circuit board.

As described above, according to the first aspect and the second aspect of the present invention, the fixed housing and the movable housing hold the terminal. The terminal includes the elastic portion accommodated in the space created between the fixed housing and the movable housing. The elastic portion includes the wave shape portions formed in one continuous band shape portion. The wave shape portion has the bent portions repeatedly bending continuously in bend directions. Accordingly, even when the elastic portion does not have a large size in the height direction thereof, it is possible to sufficiently secure the elastic deformation amount. As a result, it is possible to minimize a size of the connector in the height direction thereof.

Further, according to the first aspect of the present invention, each of the wave shape portions situated adjacent to the fixed side held portion and the movable side held portion has the enlarging width portion, in which the opening width of the wave shape increases away from the bent portions. Accordingly, when the wave portions are elastically deformed in the width direction thereof, and the wave shape portions situated adjacent to the fixed side held portion and the movable side held portion approach closer to each other at base portions thereof, the wave shape portions do not contact with each other. Accordingly, it is possible to prevent the terminal from being damaged. Further, it is possible to secure a sufficient floating amount.

Further, according to the second aspect of the present invention, the wave shape portions are not disposed between the fixed side transition portion and the movable side transition portion in the direction connecting between the fixed side transition portion and the movable side transition portion (the width direction of the wave shape portions). Accordingly, even when the wave portions are elastically deformed in the width direction thereof, the fixed side transition portion does not contact with the movable side transition portion.

BRIEF DESCRIPTION OF THE DRAWINGS

FIGS. 1(A) and 1(B) are perspective views showing an electrical connector assembled member including a plug side connector (a first connector) and a receptacle side connector (a second connector) to be connected to the plug side connector according to an embodiment of the present invention, wherein FIG. 1(A) is a perspective view showing the electrical connector assembled member before the first connector is connected to the second connector and FIG. 1(B) is a perspective view showing the electrical connector assembled member after the first connector is connected to the second connector;

FIGS. 2(A) and 2(B) are sectional views showing the electrical connector assembled member according to the embodiment of the present invention, wherein FIG. 2(A) is a sectional view showing the electrical connector assembled member before the first connector is connected to the second connector and FIG. 2(B) is a sectional view showing the electrical connector assembled member after the first connector is connected to the second connector;

FIGS. 3(A) and 3(B) are views showing the first connector according to the embodiment of the present invention, wherein FIG. 3(A) is a perspective view showing the first connector and FIG. 3(B) is a sectional view showing the first connector;

FIGS. 4(A) and 4(B) are views showing the second connector according to the embodiment of the present invention, wherein FIG. 4(A) is a perspective view showing the second connector and FIG. 4(B) is a sectional view showing the second connector.

DETAILED DESCRIPTION OF PREFERRED EMBODIMENTS

Hereunder, embodiments of the present invention will be described with reference to the accompanying drawings.

Figure 1:
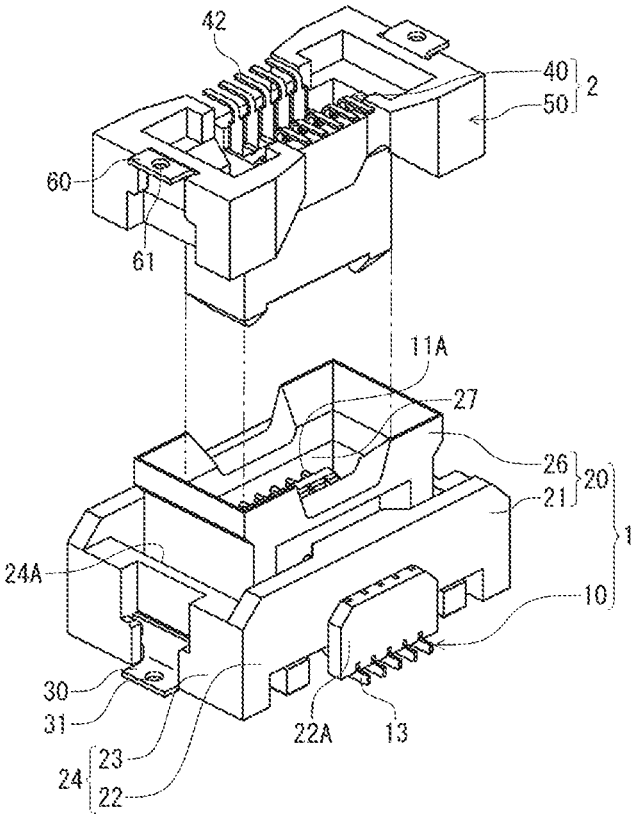
Figure 1:
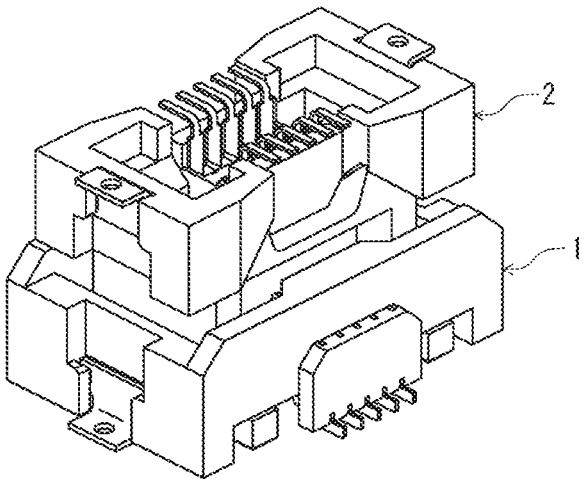

An embodiment of the present invention will be explained. FIGS. 1(A) and 1(B) are perspective views showing an electrical connector assembled member including a plug side connector (a first connector 1) and a receptacle side connector (a second connector 2) to be connected to the plug side connector according to an embodiment of the present invention. More specifically, FIG. 1(A) is a perspective view showing the electrical connector assembled member before the first connector 1 is connected to the second connector 2, and FIG. 1(B) is a perspective view showing the electrical connector assembled member after the first connector 1 is connected to the second connector 2.

Figure 2:
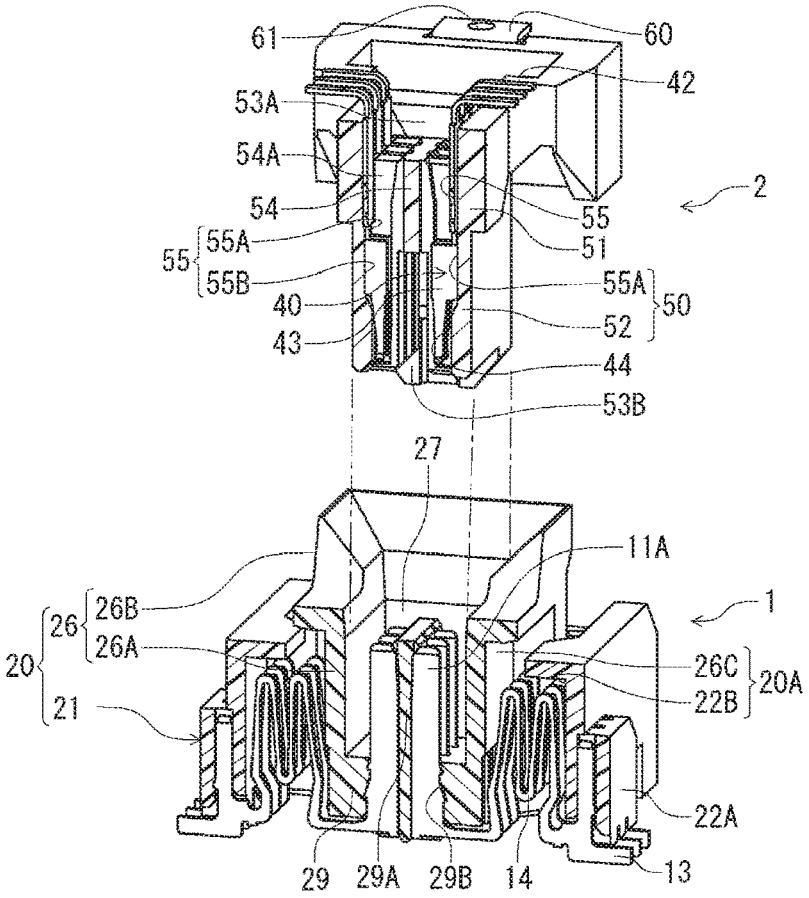
Figure 2:
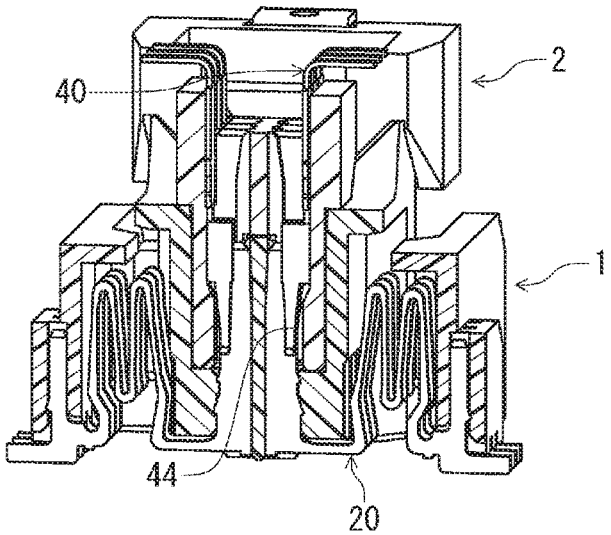

FIGS. 2(A) and 2(B) are sectional views showing the electrical connector assembled member according to the embodiment of the present invention. More specifically, FIG. 2(A) is a sectional view showing the electrical connector assembled member before the first connector 1 is connected to the second connector 2, and FIG. 2(B) is a sectional view showing the electrical connector assembled member after the first connector 1 is connected to the second connector 2.

Figure 3:
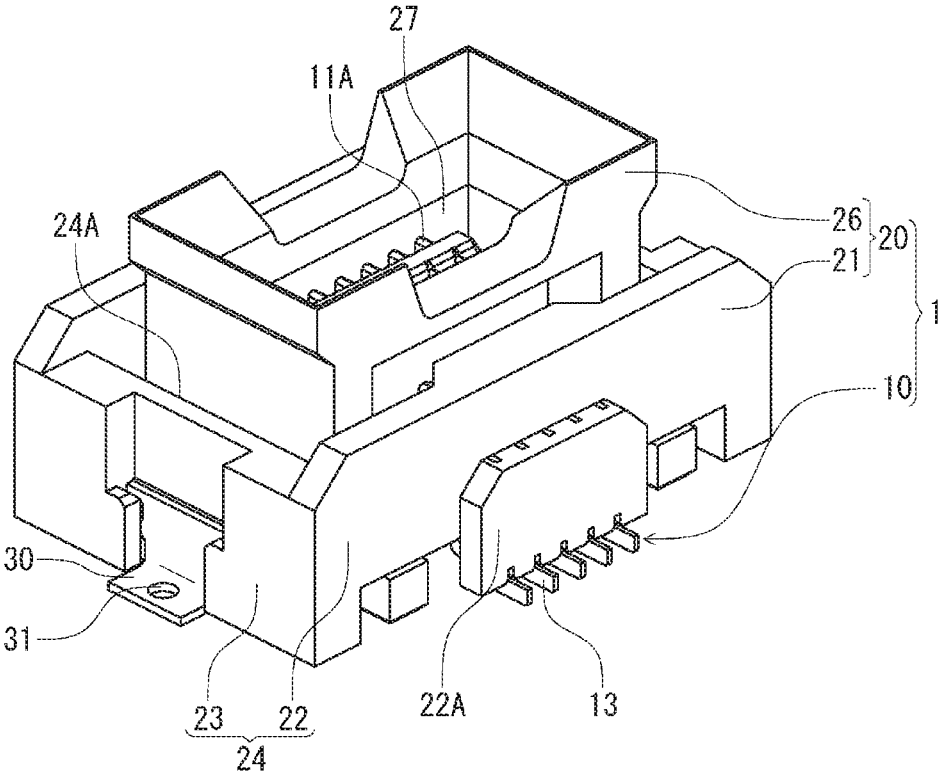
Figure 3:
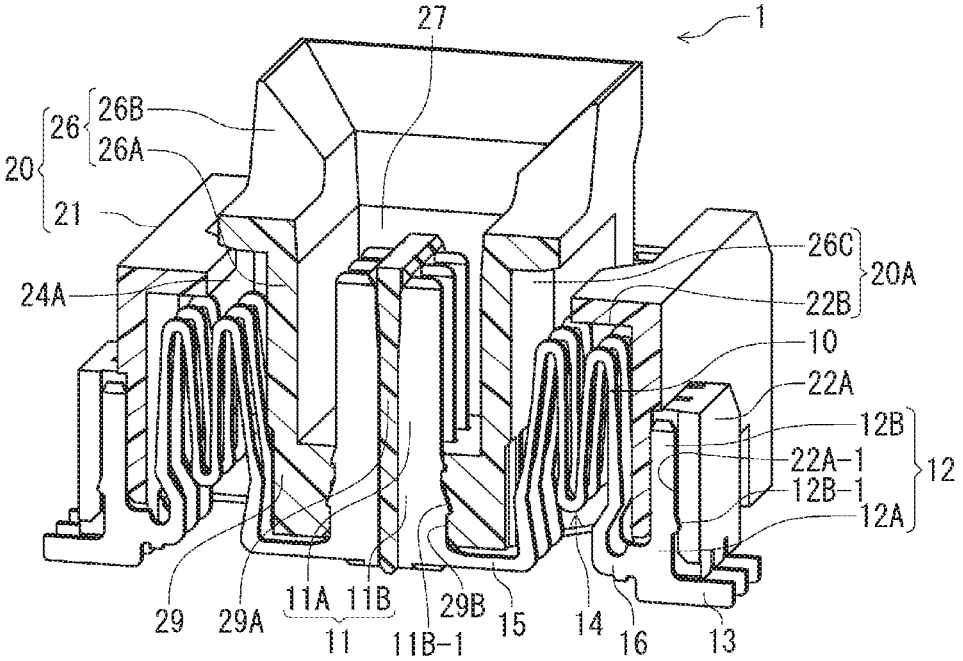
Figure 4:
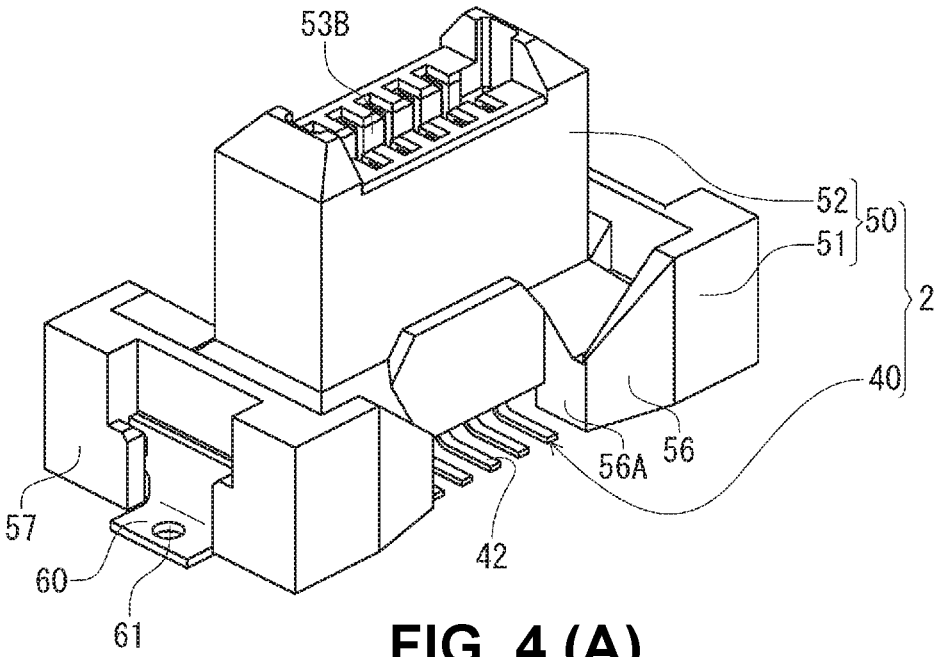
Figure 4:
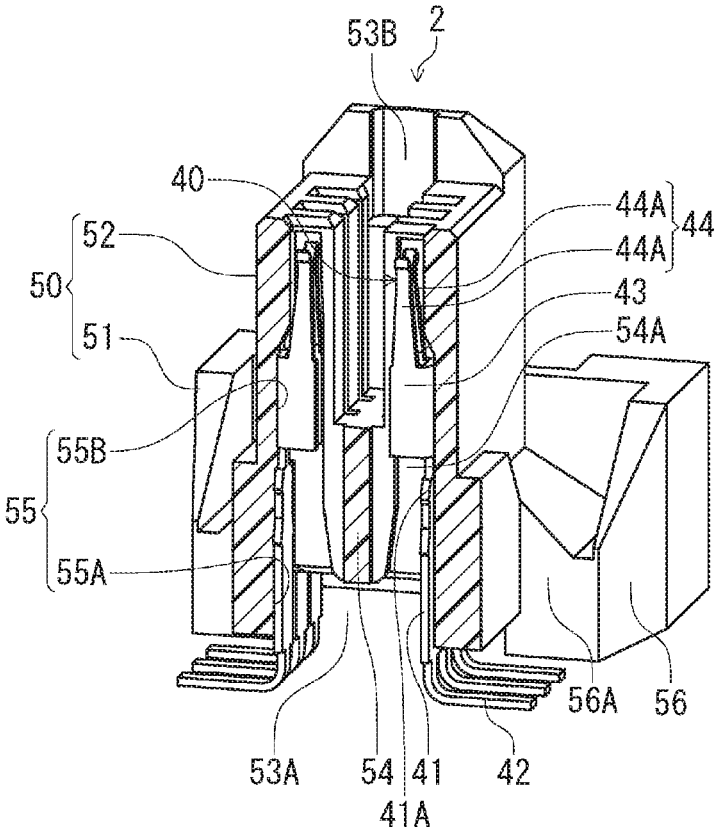

FIGS. 3(A) and 3(B) are views showing the first connector 1 according to the embodiment of the present invention. More specifically, wherein FIG. 3(A) is a perspective view showing the first connector 1 and FIG. 3(B) is a sectional view showing the first connector 1. FIGS. 4(A) and 4(B) are views showing the second connector 2 according to the embodiment of the present invention. More specifically, FIG. 4(A) is a perspective view showing the second connector 2, and FIG. 4(B) is a sectional view showing the second connector 2.

As shown in FIG. 1(A), the first connector 1 includes first terminals 10 with a male type and a first housing 20 formed of an electrically insulation material for holding the first terminals 10. It should be noted that the terminal and the housing of the first connector 1 are designated with "first", and the terminal and the housing of the second connector 2 are designated with "second". Further, the first housing 20 includes a fixed housing 21 and a movable housing 26. The fixed housing 21 is to be attached to an electrical circuit board (not shown) through the first terminals 10. The movable housing 26 is configured to be movable relative to the fixed housing 21.

In the embodiment, the first housing 20 of the first connector 1 is formed in a substantially cuboid shape extending in a longitudinal direction and a lateral direction along a plane in parallel to the electrical circuit board. The first terminals 10 are arranged in two rows along the longitudinal direction of the first housing 20. More specifically, the first terminals 10 are arranged in two rows to face each other symmetrically in the lateral direction (a width direction of the first connector 1) perpendicular to the longitudinal direction.

As shown in FIG. 1(A), the fixed housing 21 includes a circumferential wall 24 formed of a side wall 22 and an edge wall 23. The side wall 22 is formed to rise perpendicularly relative to the electrical circuit board and extend in the longitudinal direction. The edge wall 23 is formed to extend in the lateral direction. A central space 24A is formed inside the circumferential wall 24 to penetrate in a vertical direction, so that the central space 24A accommodates the movable housing 26 from above.

In the embodiment, the side wall 22 extends over a terminal arrangement range where the first terminals 10 are arranged in the longitudinal direction. A protruding wall 22A is formed on an outer wall surface of the side wall 22, so that the protruding wall 22A holds the first terminals 10. A fixed side recess portion 22B is formed in an inner wall surface of the side wall 22, so that the fixed side recess portion 22B opens inwardly and downwardly. It should be noted that the fixed side recess portion 22B forms a part of an accommodation space 20A for accommodating an elastic portion of the first terminal 10 (described later). Further, the protruding wall 22A and the fixed side recess portion 22B will be described in more detail later relative to the first terminals 10.

In the embodiment, an attachment metal member 30 with an L character shape is attached to the edge wall 23 of the fixed housing 21 on an outer surface thereof, so that the fixed housing 21 is securely fixed to the electrical circuit board through an attachment hole 31 formed in the attachment metal member 30 with solder. It should be noted that it is not necessary to provide the attachment metal member 30 for attaching the fixed housing 21 to the electrical circuit board. Alternatively, when the first terminals 10 can be securely attached to the electrical circuit board with solder, it is not necessary to provide the attachment metal member 30.

In the embodiment, the movable housing 26 includes a penetrating portion 26A and a protruding portion 26B. The penetrating portion 26A is arranged to penetrate into the central space 24A of the fixed housing 21. The protruding portion 26B is arranged to protrude upwardly from the central space 24A. Further, the movable housing 26 includes a receiving recess portion 27 disposed to open upwardly over a range from the protruding portion 26B to the penetrating portion 26A, so that the receiving recess portion 27 receives a mating connecting member, for example, the second connector 2 as a mating connector.

In the embodiment, a central protruding wall 29A is disposed inside the receiving recess portion 27. The central protruding wall 29A is arranged to rise from a bottom wall 29 of the movable housing 26, so that the central protruding wall 29A holds the first terminals 10. A movable side recess portion 26C is formed in an outer surface of the penetrating portion 26A of the movable housing 26, so that the movable side recess portion 26C opens downwardly to face the fixed side recess portion 21B of the fixed housing 21. It should be noted that the movable side recess portion 26C and the fixed side recess portion 22B form the accommodation space 20A for accommodating the elastic portion of the first terminal 10 (described later).

Figure 5:
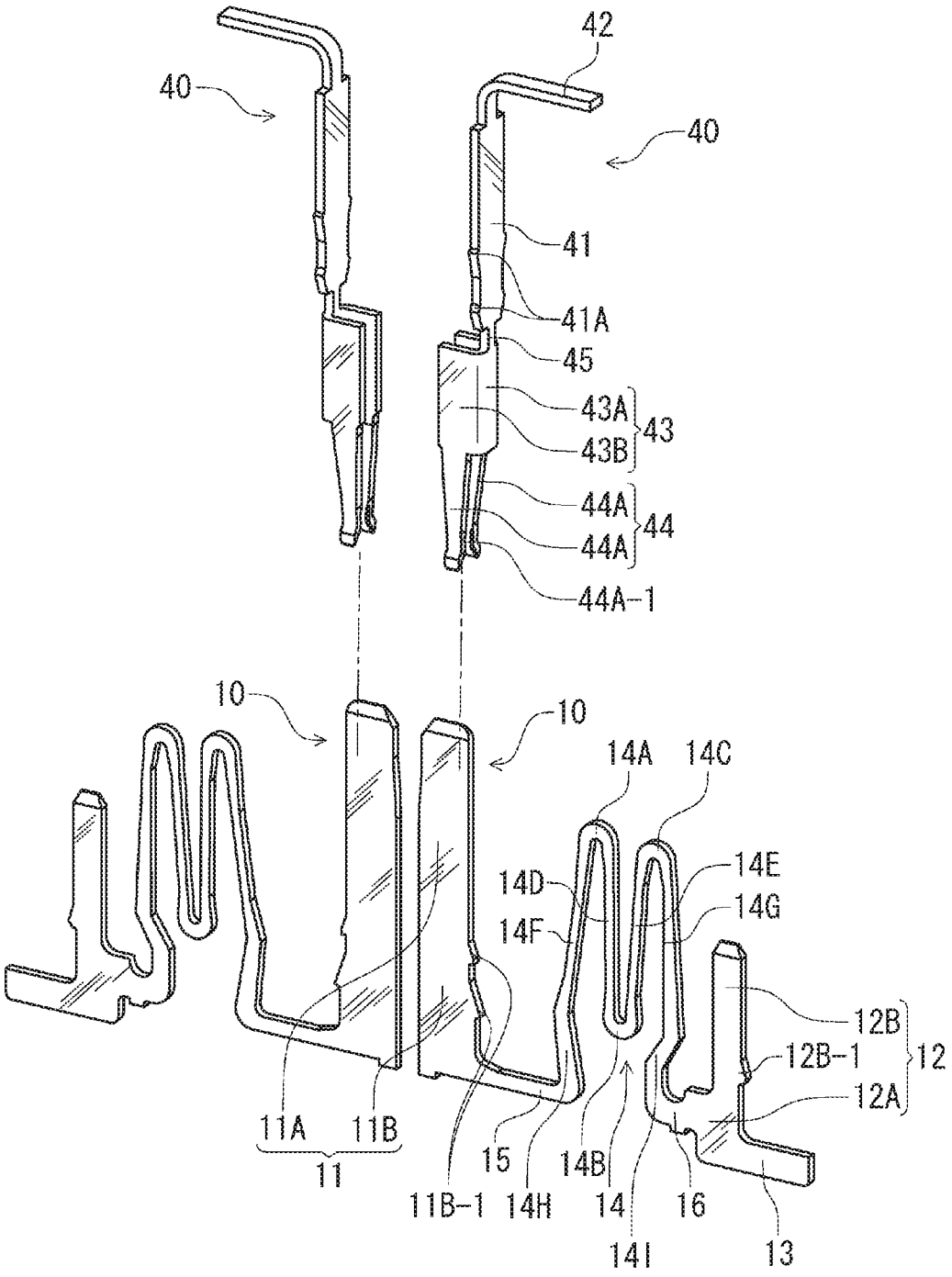
FIG. 5 is a perspective view showing a first terminal of the first connector and a second terminal of the second connector according to the embodiment of the present invention.

FIG. 5 is a perspective view showing the first terminal 10 of the first connector 1 and a second terminal 40 of the second connector 2 according to the embodiment of the present invention.

As shown in FIG. 5, the first terminal 10 as a male terminal is formed such that a flat surface of a metal plate is maintained. Further, the first terminals 10 are arranged in a pair to face with each other in a same direction, so that the first terminals 10 with the same shape become right-to-left symmetrical in the width direction of the first connector 1. Further, the first terminals 10 are arranged in a plurality of pairs in the longitudinal direction of the first connector 1.

As shown in FIG. 5, among a plurality of pairs of the first terminals 10, one pair of the first terminals 10 is taken out from the first housing 20. Further, one pair of the second terminals 40 of the second connector 2, which is to be connected to the first connector 1 as the mating connector, are shown in FIG. 5. It should be noted that two of the first terminals 10 constituting the pair are arranged right-to-left symmetrically, and have an identical shape. In the following description, therefore, one of the first terminals 10 will be explained.

In the embodiment, the first terminal 10 includes a movable side column portion 11; a fixed side column portion 12; a connecting portion 13; and an elastic portion 14. The movable side column portion 11 is arranged to rise at a position close to the second terminal 40 as a mating member, so that the movable side column portion 11 faces the second terminal 40 in the width direction of the first connector 1. Further, the movable housing 26 is configured to hold the movable side column portion 11. The fixed side column portion 12 is arranged to rise at a position opposite to that of the movable side column portion 11 in the width direction of the first connector 1. The connecting portion 13 is arranged to extend in the lateral direction from a lower end of the fixed side column portion 12. The elastic portion 14 is disposed between the movable side column portion 11 and the fixed side column portion 12.

In the embodiment, the movable side column portion 11 includes a contact portion 11A at an upper half portion thereof and a movable side held portion 11B at a lower half portion thereof. The contact portion 11A is configured to contact with the second terminal 40, which is a female type, of the second connector 2. The movable side held portion 11B is held with the movable housing 26. The contact portion 11A has a distal end portion (an upper end portion) that is chamfered, so that the movable side column portion 11 is easily inserted into the second terminal 40. The movable side held portion 11B has an engaging protrusion 11B-1 at a side edge thereof, so that the movable side column portion 11 can engage with the movable housing 26.

In the embodiment, the movable side held portion 11B is tightly fitted into a hold groove 29B formed in the bottom wall 29 of the movable housing 26 from above, so that the hold groove 29B holds the movable side held portion 11B (refer to FIG. 3(B)). When the movable side held portion 11B is fitted into the hold groove 29B, the engaging protrusion 11B-1 bites a corresponding inner surface of the hold grove 29B, so that the engaging protrusion 11B-1 strongly engages with the hold grove 29B.

In the embodiment, the fixed side column portion 12 includes a base portion 12A at a lower end portion thereof and a fixed side held portion 12B at an upper portion thereof above the base portion 12A. The fixed side held portion 12B has an engaging protrusion 12B-1, so that the fixed side column portion 12 can engage with the fixed housing 21. Further, the fixed side held portion 12B is tightly fitted from below into a hold groove 22A-1 formed in the protruding wall 22A that protrudes from the side wall 22 of the fixed housing 21 at a bottom wall surface thereof and penetrates in a vertical direction within a thickness of the protruding wall 22A, so that the hold groove 22A-1 holds the fixed side held portion 12B (refer to FIG. 3(B)). When the fixed side held portion 12B is fitted into the hold groove 22A-1, the engaging protrusion 12B-1 bites a corresponding inner surface of the hold grove 22A-1, so that the engaging protrusion 12B-1 strongly engages with the hold grove 22A-1.

In the embodiment, the connecting portion 13 is arranged to extend from a lower end of the base portion 12A of the fixed side column portion 12 in the lateral direction along a lower surface of the fixed housing 21. Further, the connecting portion 13 is arranged to extend toward an outside of the fixed housing 21.

In the embodiment, the first terminal 10 includes the elastic portion 14 at a position between the movable side held portion 11B and the fixed side held portion 12B. The elastic portion 14 is connected on the left side to the movable side held portion 11B through a movable side transition portion 15 that extends from the lower end of the movable side held portion 11B in the lateral direction. Further, the elastic portion 14 is connected on the right side to the fixed side held portion 12B through a fixed side transition portion 16 that extends from the base portion 12A of the fixed side held portion 12B in the lateral direction.

In the embodiment, the elastic portion 14 is configured to rise from the movable side transition portion 15 and the fixed side transition portion 16, and is formed of a continuous band shape member bent in a substantially M character shape. Further, the elastic portion 14 with the substantially M character shape is formed in a band shape having a width smaller than that of the movable side held portion 11B and the fixed side held portion 12B.

More specifically, the elastic portion 14 includes two bent portions 14A and 14C having a curved shape at an upper portion thereof and a bent portion 14B having a curved shape at a lower portion thereof. Further, the elastic portion 14 includes an inside straight portion 14D connecting the bent portion 14A and the bent portion 14B and an inside straight portion 14E connecting the bent portion 14C and the bent portion 14B. Further, the elastic portion 14 includes outside straight portions 14F and 14G extending outwardly from the bent portion 14A and the bent portion 14C, respectively.

As described above, in the embodiment, the elastic portion 14 is formed in the substantially M character shape, in which one wave shape portion with a substantially U character shape is disposed between two wave shape portions with a substantially U character shape. Accordingly, the elastic portion 14 is formed in a wave shape having three wave shapes arranged continuously, so that the elastic portion 14 is capable of elastically deforming. It should be noted that the three wave shape portions is formed of the bent portion and the straight portions. Further, in the three wave shape portions of the elastic portion 14, the straight portions 14D, 14E, 14F, and 14G form widening width portions that are inclined such that an open width of the wave shape portions is increasing in a direction away from the bent portions 14A, 14C, and 14B, respectively.

In the embodiment, among the three wave shape portions of the elastic portion 14, the wave shape portion situated on the left side includes an inclined portion 14H. The inclined portion 14H is arranged to extend downwardly from the outside straight portion 14F, and is inclined inwardly (the right side in FIG. 5) and downwardly at a lower position below the bent portion 14B in the vertical direction. Further, the wave shape portion situated on the right side includes an inclined portion 14I. The inclined portion 14I is arranged to extend downwardly from the outside straight portion 14G, and is inclined inwardly (the left side in FIG. 5) and downwardly at a lower position below the bent portion 14B in the vertical direction.

As described above, in the elastic portion 14, the inclined portion 14H and the inclined portion 14I are inclined inwardly and downwardly. Accordingly, a distance between the inclined portion 14H and the inclined portion 14I is reduced in a range below the bent portion 14B situated at the lower portion of the elastic portion 14.

In the embodiment, the elastic portion 14 is formed in the band shape with the small width, and is formed in the wave shape so that the elastic portion 14 is capable of elastically deforming. More specifically, in the elastic portion 14, the straight portions 14D, 14E, 14F, and 14G have central portions having a terminal width (a band width) gradually decreasing and smaller than that of the bent portions 14A and 14C. Further, the straight portions 14D and 14E situated at the inside have the central portions having the terminal width (the band width) gradually decreasing and smaller than that of the bent portion 14B. Further, the straight portions 14F and 14G situated at the outside have the central portions having the terminal width (the band width) gradually decreasing and smaller than that of the inclined portions 14H and 14I. It should be noted that the elastic portion 14 may have a portion having a width gradually decreasing at a position other than the central portion of the straight portions 14D, 14E, 14F, and 14G. With the portion having the width gradually decreasing, the elastic portion 14 is capable of easily and elastically deforming with the bent portion as a pivot.

As shown in FIGS. 1(A) and 1(B), FIGS. 2(A) and 2(B), and FIGS. 4(A) and 4(B), the second connector 2 includes the second terminals 40 with a female type and a second housing 50 formed of an electrically insulation material for holding the second terminals 40. Further, the second housing 50 is attached to the electrical circuit board (not shown) through the second terminals 40.

In the embodiment, the second housing 50 of the second connector 2 is formed in a substantially cuboid shape extending in a longitudinal direction thereof corresponding to the longitudinal direction of the first housing 20 of the first connector 1 and a lateral direction thereof corresponding to the lateral direction of the first housing 20 of the first connector 1. The second terminals 40 are arranged in two rows along the longitudinal direction of the second housing 50. More specifically, the second terminals 40 are arranged in two rows to face each other in the lateral direction (a width direction of the second connector 2) perpendicular to the longitudinal direction. It should be noted that the second connector 2 is shown to face the first connector 1 in a fitting direction thereof in FIGS. 1(A) and 2(A). Further, the second connector 2 is shown in a posture turned over in the vertical direction in FIGS. 4(A) and 4(B).

In the embodiment, the second housing 50 of the second connector 2 that is the mating connector of the first connector 1 includes an attaching block portion 51 and a fitting block portion 52. The attaching block portion 51 is to be attached to the electrical circuit board (not shown). The fitting block portion 52 is configured to protrude from the attaching block portion 51 in a fitting direction relative to the first connector 1. Further, each of the attaching block portion 51 and the fitting block portion 52 is formed in a substantially cuboid shape extending in a longitudinal direction thereof corresponding to the longitudinal direction of the first connector 1 and a lateral direction thereof corresponding to the lateral direction of the first connector 1.

In the embodiment, the second housing 50 includes an upper recess portion 53A at an upper portion thereof and a lower recess portion 53B at a lower portion thereof. The upper recess portion 53A and the lower recess portion 53B are situated at a center of the attaching block portion 51 viewed from above in FIGS. 1(A)-1(B) and 2(A)-2(B). Further, the lower recess portion 53B has a width smaller than that of the upper recess portion 53A, and a depth greater than that of the upper recess portion 53A. Further, the second housing 50 includes a central wall portion 54 between the upper recess portion 53A and the lower recess portion 53B. Further, the second housing 50 includes a terminal groove 55. The terminal groove 55 is arranged to extend along inner surfaces of the upper recess portion 53A and the lower recess portion 53B, and penetrate through the central wall portion 54. The second terminal 40 is fitted into and held with the terminal groove 55 (described later).

In the embodiment, the second housing 50 further includes a side wall 56 extending in the longitudinal direction of the attaching block portion 51, and a recess wall portion 56A is formed in an outer surface of the side wall 56 at a central portion thereof in the longitudinal direction (refer to FIG. 4(A)). The recess wall portion 56A is recessed in the lateral direction. A connecting portion 42 of the second terminal 40 is accommodated in the recess wall portion 56A, so that it is possible to easily connect the connecting portion 42 to the electrical circuit board and confirm that the connecting portion 42 is securely connected to the electrical circuit board.

In the embodiment, the second housing 50 further includes an edge wall 57 and an attachment metal member 60 with an L character shape attached to an outer surface of the edge wall 57. The attachment metal member 60 has an attachment hole 61, so that the second housing 50 is securely fixed to the electrical circuit board with solder. It should be noted that it is not necessary to provide the attachment metal member 60 for attaching the second housing 50 to the electrical circuit board. Alternatively, when the second terminals 40 can be securely attached to the electrical circuit board with solder, it is not necessary to provide the attachment metal member 60.

As described above, FIG. 5 is the perspective view showing the first terminal 10 of the first connector 1 and the second terminal 40 of the second connector 2 before the first connector 1 is connected to the second connector 2 according to the embodiment of the present invention.

As shown in FIG. 5, the second terminal 40 as a female terminal is formed of a metal plate member bent in a plate thickness direction. Further, similar to the first terminals 10, the second terminals 40 are arranged in a pair to face with each other in a same direction, so that the second terminals 40 with the same shape become right-to-left symmetrical in the width direction of the second connector 2. Further, the second terminals 40 are arranged in a plurality of pairs in the longitudinal direction of the second connector 2.

As shown in FIG. 5, among a plurality of pairs of the second terminals 40, one pair of the second terminals 40 is taken out from the second housing 50. It should be noted that two of the second terminals 40 constituting the pair are arranged right-to-left symmetrically, and have an identical shape. In the following description, therefore, one of the second terminals 40 will be explained.

In the embodiment, the second terminal 40 includes a held portion 41; a connecting portion 42; an intermediate base portion 43; and a contact portion 44. The held portion 41 is arranged at a middle portion of the second terminal 40, and is formed in a flat band shape having a plate surface perpendicular to the plate surface of the first terminal 10. The connecting portion 42 is arranged above the held portion 41, and is bent perpendicular to the plate surface of the held portion 41. The intermediate base portion 43 is arranged at the middle portion of the second terminal 40 and below the held portion 41. Further, the intermediate base portion 43 has a cross section having a U character shape. The contact portion 44 is formed of a pair of contact pieces 44A extending in a finger shape.

In the embodiment, the held portion 41 is formed in a flat plate shape. Further, the held portion 41 includes engaging protrusions 41A for biting a corresponding surface of the terminal groove 55 of the second housing 50.

In the embodiment, the second terminal 40 further includes a connecting portion 45 having a narrow width portion. The held portion 43 is connected to the held portion 41 through the connecting portion 45. Further, the intermediate base portion 43 includes a bottom surface portion 43A having a plate shape and a side surface portion 43B. The bottom surface portion 43A is configured to extend downwardly from the plate surface of the held portion 41. The side surface portion 43B is configured to extend from both side edges of the bottom surface portion 43A, and has a plate surface perpendicular to a plate surface of the bottom surface portion 43A. Accordingly, the intermediate base portion 43 is formed in a U character shape with the bottom surface portion 43A and the side surface portion 43B.

As described above, the contact portion 44 is formed of a pair of the contact pieces 44A extending in a finger shape. The contact pieces 44A are arranged to extend from lower ends of the side surface portion 43B on both sides of the intermediate base portion 43, so that the contact pieces 44A face with each other. Further, the contact pieces 44A are inclined downwardly in a direction such that a distance in between gradually decreases, so that the contact pieces 44A become closer. Further, the distance between the contact pieces 44A becomes a minimum near lower ends thereof, and the contact pieces 44A expend at the lower ends thereof, so that a throat portion 44A-1 is formed at a location where the distance between the contact pieces 44A becomes a minimum. The distance between the contact pieces 44A at the throat portion 44A-1 is smaller than a plate thickness of the contact portion 11A of the first terminal 10, so that the contact pieces 44A tightly sandwich and elastically contact with the contact portion 11A at the throat portion 44A-1.

With the configuration described above, the second terminals 40 are inserted into the terminal grooves 55 of the second housing 50 from above as shown in FIGS. 1(A)-1(B) and 2(A)-2(B). It should be noted that the second terminals 40 are inserted from blow in FIGS. 4(A) and 4(B), in which the second connector 2 is turned over vertically as opposed to that shown in FIGS. 1(A)-1(B) and 2(A)-2(B).

As shown in FIG. 2(A), the terminal groove 55 includes a rectangular cylindrical hole portion 54A formed in the central wall portion 54. The rectangular cylindrical hole portion 54A has an inner circumferential shape corresponding to an outer circumferential shape of the intermediate base portion 43 having the U character shape section, that is the maximum circumferential shape of the second terminal 40. Further, the rectangular cylindrical hole portion 54A is formed to penetrate the central wall portion 54 in the vertical direction, so that the intermediate base portion 43 is capable of passing through the rectangular cylindrical hole portion 54A.

Further, the terminal groove 55 includes a groove portion 55A formed in inner wall surfaces of the rectangular cylindrical hole portion 54A and the upper recess portion 53A. The groove portion 55A has a groove depth corresponding to the plate thickness of the held portion 41. Accordingly, after the intermediate base portion 43 with the U character shape section passes through the rectangular cylindrical hole portion 54A of the central wall portion 54, the groove portion 55A accommodates the held portion 41 with the flat band shape situated at the inner wall surface of the upper recess portion 53A. Further, when the engaging protrusion 41A of the held portion 41 is tightly fitted into the groove portion 55A of the terminal groove 55, the engaging protrusion 41A bites into an inner surface of the groove portion 55A, so that the second housing 50 securely holds the second terminal 40 and prevents the second terminal 40 from coming off.

Further, the terminal groove 55 includes a groove portion 55B formed in an inner wall surface of the lower recess portion 53B below the central wall portion 54 (above in FIG. 4(B). When the second terminal 40 is tightly fitted into the specific position, the groove portion 55B accommodates the intermediate base portion 43 and the contact portion 44. The groove portion 55B is arranged relative to the intermediate base portion 43 such that a groove bottom surface of the groove portion 55B contacts with or is away from the bottom surface portion 43A of the intermediate base portion 43, and a groove side surface of the groove portion 55B is away from the side surface portion 43B of the intermediate base portion 43. Further, the groove portion 55B is arranged relative to the contact portion 44 to form a space in which the contact pieces 44A are capable of elastically deforming.

A method of using the first connector 1 and the second connector 2 will be explained next. First, the first connector 1 and the second connector 2 are attached to the electrical circuit boards with solder, respectively. More specifically, the first connector 1 is attached to the electrical circuit board with the connecting portions 13 of the first terminals 10 and the attachment metal members 30. Further, the second connector 2 is attached to the electrical circuit board with the connecting portions 42 of the second terminals 40 and the attachment metal members 60. It should be noted that the electrical circuit boards are not shown in FIGS. 1(A)-1(B) and 2(A)-2(B). It should be noted that the first connector 1 is attached to the electrical circuit board at the lower surface thereof, and the second connector 2 is attached to the electrical circuit board at the upper surface thereof.

As shown in FIG. 1(A) and FIG. 2(A), in the next step, the second connector 2 attached to the electrical circuit board at the upper surface thereof is placed above the first connector 1. It should be noted that at this moment, the fitting block portion 52 of the second connector 2 faces downwardly. Afterward, the second connector 2 is moved downwardly while maintaining the posture, so that the fitting block portion 52 is inserted into the receiving recess portion 27 of the movable housing 26 of the first connector 1. As a result, the fitting block portion 52 is fitted into the movable housing 26 (refer to FIG. 1(B) and FIG. 2(B)).

When the second connector 2 is fitted into the first connector 1, the contact portions 44 formed of the contact pieces 44A with the finger shape tightly sandwich the contact portions 11A of the first terminals 10 of the first connector 1. Accordingly, the second terminals 40 of the second connector 2 elastically contact with the contact portions 11A of the first terminals 10.

As described above, the contact portions 44 of the second terminals 40 have the throat portions 44A-1 at the lower end of the contact portions 44A. Accordingly, when the contact portions 11A with the flat band shape of the first terminals 10 are smoothly inserted into the throat portion 44A-1, the contact portions 44A tightly sandwich the contact portions 11A of the first terminals 10 with the elastic force, and the second terminals 40 are electrically connected to the first terminals 10.

When the first connector 1 is connected to the second connector 2, the electrical circuit board attached to the first connector 1 is electrically connected to the electrical circuit board attached to the second connector 2 through the first terminals 10 and the second terminals 40.

As described above, the first terminals 10 of the first connector 1 have the elastic portions 14. Accordingly, even when the second connector 2 is shifted from the standard position or the standard posture in the longitudinal direction, the lateral direction, or the pulling out direction of the second connector 2, it is possible to absorb the shift through the elastic portions 14. Further, even when the first connector 1 or the second connector 2 receives vibrations, it is possible to absorb the vibrations through the elastic portions 14.

Further, in the embodiment, in addition to the elastic portions 14, the contact portions 11A of the first terminals 10 are formed in the flat band shape. Accordingly, when the contact portions 44 sandwich the contact portions 11A, the throat portions 44A-1 are capable of sliding and shifting (moving) relative to the contact portions 11A, even though friction is caused between the throat portions 44A-1 and the contact portions 11A in the lateral direction and the pulling out direction of the first connector 1. As a result, it is possible to absorb the shift or the vibrations through the contact portions 11A.

More specifically, as described above, the first terminal 10 has the movable side held portion 11B held with the movable housing 26 and the fixed side held portion 12B held with the fixed housing 21. Further, the elastic portion 14 is disposed between the movable side held portion 11B and the fixed side held portion 12B, and is connected to the movable side held portion 11B and the fixed side held portion 12B through the movable side transition portion 15 and the fixed side transition portion 16, respectively.

Further, as described above, the elastic portion 14 is formed of the wave portions having the substantially M character shape and rising from the movable side transition portion 15 and the fixed side transition portion 16. Accordingly, the elastic portion 14 is capable of elastically deforming in any of the connector height direction, the connector longitudinal direction, and the lateral direction (the connector width direction). As a result, even when the first connector 1 and the second connector 2 are shifted or receive the vibrations in any direction, it is possible to absorb the shift or the vibrations.

Further, in the embodiment, the straight portions 14D, 14E, 14F, and 14G form the widening width portions that are inclined such that the open width of the wave shape portions is increasing in the direction away from the bent portions 14A, 14C, and 14B, respectively. The wave portions are formed in the U character shape at the center thereof, and the inverted U character shape at the both sides. Accordingly, even when the movable housing 26 and the fixed housing 21 pushes the elastic portions 14 in the connector width direction and the wave portions approach to each other, the wave portions tend not to contact with each other. As a result, it is possible to secure an amount of the elastic deformation of the elastic portions 14.

In the embodiment, as described above, the elastic portion 14 has the straight portions 14D, 14E, 14F, and 14G inclined to form the widening width portions in the wave shape portions. It is suffice that at least the wave shape portions situated at the both outside sides adjacent to the movable side held portion 11B and the fixed side held portion 12B have the widening width portions. The wave shape portion situated at the center may not be inclined to form the widening width portion.

Further, in the embodiment, the straight portions 14F and 14G situated at the both outsides are connected to the movable side transition portion 15 and the fixed side transition portion 16 through the inclined portions 14H and 14I, respectively, which are inclined to get closer to each other at the lower position below the bent portion 14B situated at the center of the elastic portion 14 in the connector width direction. Accordingly, there is no wave shape portion between the movable side transition portion 15 and the fixed side transition portion 16. As a result, even when the elastic portion 14 is pushed and elastically shifted in the connector width direction, the movable side transition portion 15 and the fixed side transition portion 16 tend not to contact with each other.

Further, in the embodiment, the straight portions 14D, 14E, 14F, and 14G have the band width smaller than that of the bent portions 14A, 14B, and 14C. Accordingly, the elastic portion 14 is capable of easily deforming with the bent portions 14A, 14B, and 14C as a pivot. Further, when a length of the straight portions 14D, 14E, 14F, and 14G is increased within an allowable range, that is, a size of the wave portions is increased, it is possible to increase the amount of the elastic deformation of the elastic portion 14 in any of the connector height direction, the connector longitudinal direction (the direction perpendicular to the plate surface of the elastic portion 14), and the lateral direction (the connector width direction).

Further, in the embodiment, the straight portions 14D, 14E, 14F, and 14G have the band width smaller than that of the bent portions 14A, 14B, and 14C. Accordingly, when the elastic portion 14 is elastically deformed, it is possible to disperse a stress applied to the bent portions 14A, 14B, and 14C to the straight portions 14D, 14E, 14F, and 14G. Accordingly, when the elastic portion 14 is elastically deformed, the bent portions 14A, 14B, and 14C and the straight portions 14D, 14E, 14F, and 14G tend not to contact with each other.

Further, in the embodiment, the straight portions 14D, 14E, 14F, and 14G have the terminal width (the band width) gradually decreasing toward the central portions thereof. It is suffice that some of the straight portions 14D, 14E, 14F, and 14G or the bent portions 14A, 14B, and 14C have the terminal width (the band width) gradually decreasing. The remaining ones of the straight portions 14D, 14E, 14F, and 14G or the bent portions 14A, 14B, and 14C may not have the terminal width (the band width) gradually decreasing.

In the embodiment, the present invention is applied to the first connector 1 and the second connector 2 attached to the electrical circuit boards arranged in parallel. Alternatively, the present invention may be applied to a connector attached to the electrical circuit boards arranged perpendicularly, that is, a triangle connector.

The disclosure of Japanese Patent Applications No. 2015-244322, filed on Dec. 15, 2015 is incorporated in the application by reference.

While the present invention has been explained with reference to the specific embodiments of the present invention, the explanation is illustrative and the present invention is limited only by the appended claims.

What is claimed is:

1. An electrical connector for connecting an electrical circuit board and a mating connector, comprising:

a terminal having a connecting portion to be connected to the electrical circuit board and a contact portion to be contacted with the mating connector; and a housing for holding the terminal, wherein said housing includes a fixed housing to be attached to the electrical circuit board and a movable housing arranged to be movable relative to the fixed housing, said terminal includes a fixed side held portion held with the fixed housing, a movable side held portion held with the movable housing, and an elastic portion situated between the fixed side held portion and the movable side held portion, said housing includes an accommodating space situated between the fixed housing and the movable housing for accommodating the elastic portion, said elastic portion includes at least a first wave shape portion and a second wave shape portion, said first wave portion includes a first bent portion and a pair of first extending portions, said first bent portion is situated above the first extending portions in a height direction of the elastic portion, said second wave shape portion includes a second bent portion and a pair of second extending portions separated from the first extending portions, said second bent portion is situated above the second extending portions in the height direction, said elastic portion includes a third bent portion between the first wave shape portion and the second wave portion so that the elastic portion has an M character shape, said terminal further includes a fixed side transition portion situated between the elastic portion and the fixed side held portion and a movable side transition portion situated between the elastic portion and the movable side held portion, and said fixed side transition portion and said movable side transition portion are situated completely below the third bent portion in the height direction.

2. The electrical connector according to claim 1, wherein one of said first extending portions is situated between the first bent portion and the second bent portion.

3. The electrical connector according to claim 1, wherein said bent portion has a first width, and each of said first extending portions has a second width smaller than the first width.

4. The electrical connector according to claim 1, wherein said elastic portion includes a first inclined portion extending downwardly from one of the first extending portions, and a second inclined portion extending downwardly from one of the second extending portions, said first inclined portion is disposed between the first wave shape portion and the fixed side transition portion, said second inclined portion is disposed between the second wave shape portion and the movable side transition portion, and said first inclined portion and said second inclined portion are inclined inwardly.

5. The electrical connector according to claim 1, wherein said first extending portions are configured to extend away from each other with a distance in between decreasing toward the first bent portion, and said second extending portions are configured to extend away from each other with a distance in between decreasing toward the second bent portion.

* * * * *